US006430887B1

(12) United States Patent
Daudet

(10) Patent No.: US 6,430,887 B1
(45) Date of Patent: Aug. 13, 2002

(54) HINGE ASSEMBLY FOR A TRUSS

(75) Inventor: Larry R. Daudet, Porter, IN (US)

(73) Assignee: Aegis Metal Framing LLC, Chesterfield, MO (US)

( * ) Notice: Subject to any disclaimer, the term of this patent is extended or adjusted under 35 U.S.C. 154(b) by 0 days.

(21) Appl. No.: 09/656,329

(22) Filed: Sep. 6, 2000

(51) Int. Cl.[7] ..... E04B 1/32

(52) U.S. Cl. ..... 52/641; 52/640; 52/645; 52/646; 52/648.1; 403/103; 403/113; 403/119; 403/163; 16/223; 16/224; 16/252; 16/254

(58) Field of Search ..... 52/640, 641, 645, 52/646, 648.1, 715, 713; 403/103, 113, 119, 163; 16/223, 224, 252, 254

(56) References Cited

U.S. PATENT DOCUMENTS

| | | | | | |
|---|---|---|---|---|---|
| 2,744,590 | A | * | 5/1956 | Butts | 211/201 |
| 3,013,297 | A | | 12/1961 | Ferry | |
| 3,352,070 | A | | 11/1967 | Raynes | |
| 3,760,550 | A | | 9/1973 | Mueller et al. | |
| 3,823,522 | A | | 7/1974 | Jureit et al. | |
| RE31,234 | E | | 5/1983 | Jureit et al. | |
| 4,450,971 | A | * | 5/1984 | Kashiwabara | 211/201 |
| 4,582,435 | A | | 4/1986 | Davis | |
| 5,094,059 | A | | 3/1992 | Ganescu | |
| 5,553,961 | A | * | 9/1996 | Olden | 403/119 |
| 5,701,713 | A | * | 12/1997 | Silver | 52/645 |
| 5,956,809 | A | * | 9/1999 | Hodgson | 16/224 |

FOREIGN PATENT DOCUMENTS

| | | |
|---|---|---|
| BE | 445594 | 6/1942 |

* cited by examiner

*Primary Examiner*—Carl D. Friedman
*Assistant Examiner*—Dennis L. Dorsey
(74) *Attorney, Agent, or Firm*—Kirkpatrick & Lockhart LLP

(57) ABSTRACT

For a truss, a hinge assembly for connecting truss members that form the truss. The hinge assembly may include a first hinge plate having a first boss formed thereon and a second hinge plate having a second boss formed thereon. The second boss defines an opening for pivotal receipt of the first boss. The hinge assembly also includes a retainer for maintaining the pivotal receipt of the first boss in the second boss. When the first hinge plate is attached to a first portion of a truss and the second hinge plate is attached to a second portion of a truss, the first and second truss portion can be pivoted relative to each other to enable portions of the truss to be collapsed for transporting purposes.

40 Claims, 9 Drawing Sheets

HINGE ASSEMBLY FOR A TRUSS

CROSS-REFERENCE TO RELATED APPLICATIONS

Not applicable.

FEDERALLY SPONSORED RESEARCH

Not applicable.

BACKGROUND OF THE INVENTION

1. Field of the Invention

The invention relates to a truss and, more particularly, to a hinge assembly for connecting truss members that form the truss.

2. Description of the Invention Background

A truss is a generally rigid frame member designed to support a structure, such as a roof or a floor. Trusses come in many shapes and sizes for a variety of applications. It is common in the building industry for trusses to be prefabricated prior to being shipped to a building or construction site. However, shipping height and width restrictions can impose constraints on truss geometry, particularly where the trusses are to be shipped via a public highway system. As a result of such shipping height and width restrictions, it is common for truss designers to design many trusses as "piggy backs." Such piggy back trusses typically comprise small portions of the overall truss design that are more easily transported to the construction site. Once the piggy back trusses are received at the building site, they are usually mounted on top of each other to obtain the desired roof geometry. When piggy back trusses are used, special field framing and bracing is typically required to ensure that loads are properly transferred and structural stability is maintained. Although piggy back trusses solve many problems encountered when shipping the trusses to the construction site, such truss arrangements typically result in additional material handling and set up costs which increase building construction costs.

An alternative to piggy back trusses is to fabricate the trusses with one or more hinge assemblies to connect the structural members which form the trusses and, thus, render the truss collapsible for shipping purposes. Examples of such arrangements are set forth in U.S. Pat. Nos. 3,823,522, 5,094,059 and 5,553,961. The hinge assemblies set forth in these U.S. Patents are primarily for use with wooden trusses and not well suited for trusses formed from, for example, steel or other metal materials.

U.S. Pat. No. 3,760,550, discloses a collapsible truss structure where the truss structure may be formed of steel channel members. Bolted arrangements are provided for pivotably and slidably connecting the members that form the truss. Such arrangement is generally not cost effective to manufacture and install. Thus, a hinge assembly for connecting structural members that form a metal truss which provides more strength while reducing material handling and set up costs in order to decrease building construction costs would be desirable.

There remains, therefore, a need for an improved hinge assembly for a truss that overcomes limitations, shortcomings and disadvantages of known hinge assemblies for trusses.

There is a further need for a hinge assembly for a truss or other structural member that can be effectively used in connection with wood and metal components alike.

SUMMARY OF THE INVENTION

The invention meets the identified need, as will be more fully understood following a review of this specification and drawing.

The invention includes a hinge assembly for a truss having a first truss member and a second truss member. In one embodiment, the hinge assembly comprises a first hinge plate having an attachment portion secured to the first truss member and an extension portion that extends from the first truss member. The first hinge plate has a first boss formed on the extension portion thereof. The hinge assembly also comprises a second hinge plate having an attachment portion secured to the second truss member and an extension portion that extends from the second truss member. The second hinge plate has a second boss formed on said extension portion thereof, wherein the second boss defines an opening for pivotal receipt of the first boss. The hinge assembly also comprises a retainer attached to the second boss to maintain the pivotal receipt of said first boss in the second boss.

In one embodiment, the first boss has a groove formed in its outer periphery that is adapted to receive a retainer clip for pivotally maintaining the first boss in the second boss.

Alternative to the described first boss with groove and clip received therein, the invention may include other means for maintaining the pivotal receipt of the first boss in the second boss.

The invention also includes a truss assembly comprising a truss, and the described hinge assembly having, for example, the first boss with groove and clip received therein or the other means for maintaining the pivotal receipt of the first boss in the second boss.

The invention also includes a truss assembly, comprising a truss having a first truss member and a second truss member. The first truss member includes a first boss formed thereon, and the second truss member includes a second boss formed thereon, the second boss defining an opening for pivotal receipt of the first boss thereby pivotally connecting the first truss member and the second truss member, the second boss having a terminal end. The assembly also includes a retainer attached to the terminal end of the second boss to maintain the pivotal receipt of the first boss in the second boss. The assembly may include alternate means for maintaining the pivotal receipt of the first boss in the second boss.

DETAILED DESCRIPTION OF THE INVENTION

Figures 1, 1A:
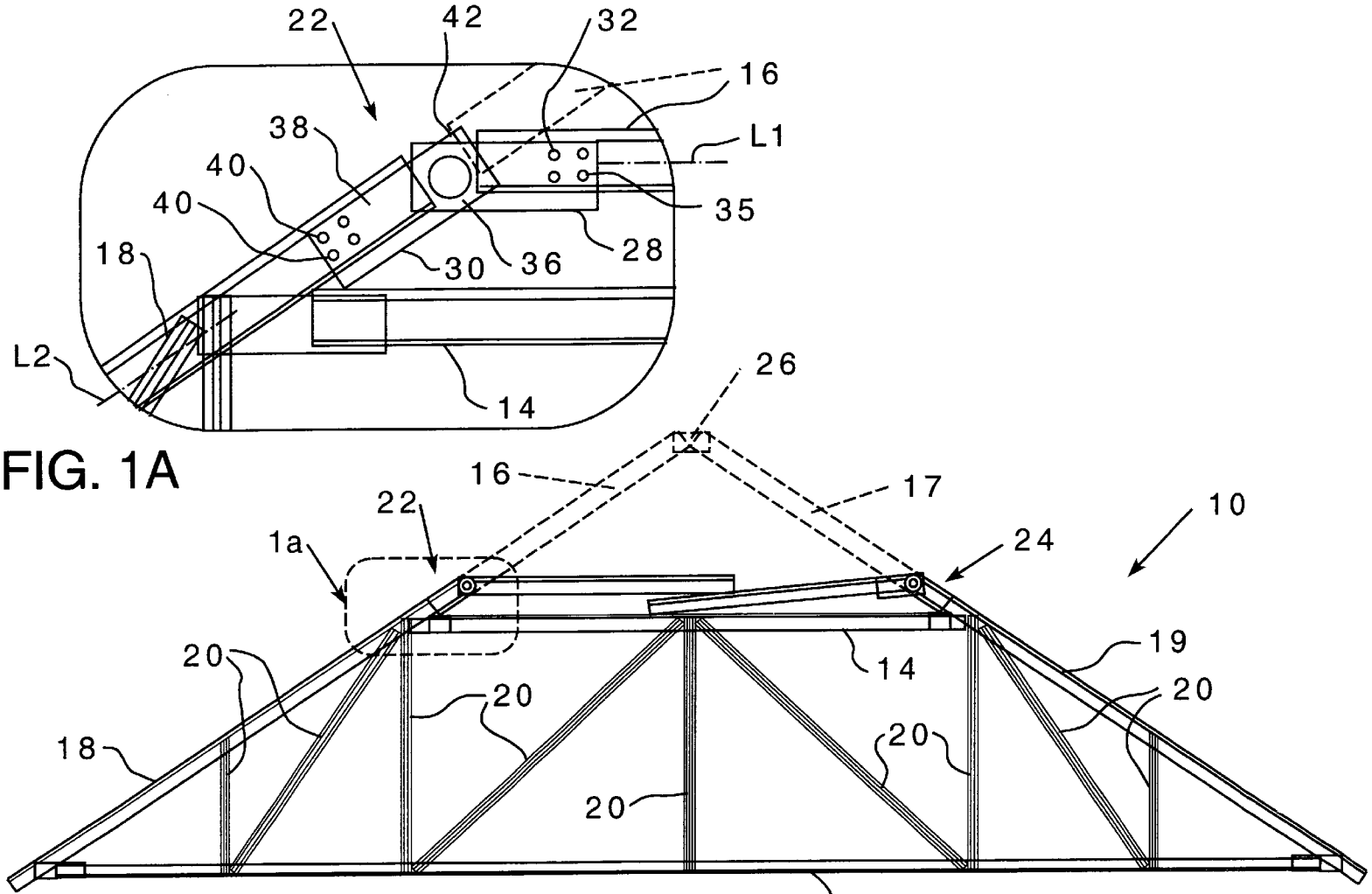
FIG. 1 is a truss assembly of the invention.
FIG. 1*a* is an enlarged, partial view of FIG. 1 illustrating a hinge assembly of one embodiment of the invention.

Referring to the drawings for purposes of illustrating the invention but not for purposes of limiting the same, there is shown in FIG. 1 a truss assembly 10 of the invention. In this embodiment, the truss assembly 10 includes a lower chord number 12 and an upper chord member 14. The truss assembly 10 may also include first truss members 16 and 17, and second truss members 18 and 19. A plurality of web braces 20 may be inter-connected between the lower chord member 12 and the upper chord member 14 or the second truss members 18 and 19 to strengthen the truss assembly 10, as is generally known in the art. The lower chord member 12 and the upper chord member 14 are connected to the second truss members 18 and 19 in a manner as is generally known in the art by using, for example, bolts or rivets (neither shown). The several members 12, 14, 16, 17, 18, 19 or 20 that make up the truss assembly 10, as described herein, may be fabricated, as is generally known, from a metal material such as, for example, cold rolled steel, hot rolled steel, stainless steel or aluminum. However, other materials such as wood, plastic, etc., could be successfully used to fabricate the truss assembly 10 in accordance with the invention. It will be further appreciated that the unique and novel aspects of the hinge assembly of the present invention may be successfully employed with trusses fabricated from more than one type of material (i.e., metal and wood).

Referring to FIGS. 1 and 1*a*, the truss assembly 10 also includes a hinge assembly, generally designated by reference number 22, for pivotally connecting the first truss member 16 and the second truss member 18. An additional hinge assembly, generally designated by reference number 24, pivotally connects the first truss member 17 and the second truss member 19. The hinge assembly 22 and the hinge assembly 24 are substantially identical and, therefore, only the hinge assembly 22 will be described in detail herein.

The hinge assembly 22 enables the first truss member 16 to be moved from a collapsed position, shown in solid line in FIG. 1, to an assembled position, shown in dotted line in FIG. 1. The first truss member 16 may be placed in the collapsed position in order to better accommodate hauling or shipping of the truss assembly 10. As can be appreciated, the first truss member 17, as a result of the pivotal connection provided by the hinge assembly 24, may also be moved between a collapsed position, shown in solid line in FIG. 1, and an assembled position, shown in dotted line in FIG. 1. Once the truss assembly 10 is ready for use, the first truss member 16 may be placed in the assembled position and connected to the first truss member 17 using an attachment member 26. Attachment member 26 may include, for example, a bolted, welded or screwed gusset plate connection to truss members 16 and 17, as is generally known.

It should be appreciated that the truss assembly 10 shown in FIG. 1 is provided for illustration purposes of the invention only and that the various members 12, 14, 16, 17, 18, 19 or 20 that make up the truss assembly 10 may be configured in an assortment of arrangements and that additional hinge assemblies may be utilized to connect various members of the truss assembly 10, as desired. It will be further appreciated that the hinge assemblies of the present invention can also be used in connection with other forms of building components and support structures without departing from the spirit and scope of the present invention.

Referring to FIGS. 1*a*, 2 and 2*a*–2*c*, the hinge assembly 22 will be described in more detail. The hinge assembly 22 includes a first hinge plate 28 for attachment to the first truss member 16 and a second hinge plate 30 for attachment to the second truss member 18. More specifically, the first hinge plate 28 includes an attachment portion 32 for securing the first hinge plate 28 to the first truss member 16. A plurality of apertures 34 may be provided in the attachment portion 32 for accommodating a corresponding plurality of fasteners, such as bolts 35. In addition, the first hinge plate 28 includes an extension portion 36 that extends from the first truss member 16, preferably extending generally longitudinally from the first truss member 16 along a longitudinal axis L1 of the first truss member 16, once the attachment portion 32 is attached to the first truss member 16.

The second hinge plate 30 includes an attachment portion 38 for securing the second hinge plate 30 to the second truss member 18. A plurality of apertures 39 may be provided through the attachment portion 38 of the second hinge plate for accommodating a corresponding plurality of fasteners, such as bolts 40, for securing the second hinge plate 30 to the second truss member 18. The second hinge plate 30 also includes an extension portion 42 that extends from the second truss member 18, preferably extending generally longitudinally from the second truss member 18 along a longitudinal axis L2 of the second truss member 18, once the second hinge plate 30 is secured to the second truss member 18. See FIG. 1*a*.

Referring to FIGS. 2 and 2*a*–2*c*, the first hinge plate 28 includes a first boss 44 formed on the extension portion 36 thereof. More specifically, the first hinge plate 28 has a web 45 that has an inner web surface 46 and an outer web surface 48 wherein the first boss 44 is formed to protrude generally outwardly from the outer surface 48 of the first hinge plate 28. The second hinge plate 30 includes a second boss 50 formed on the extension portion 42 thereof. The second hinge plate 30 has a web 51 that has an inner web surface 52 and an outer web surface 54 wherein the second boss 50 protrudes generally outwardly from the inner web surface 52 of the second hinge plate 30.

The second boss 50 defines an opening 56 for coaxial and pivotal receipt of the first boss 44 within the second boss 50.

Figure 2:
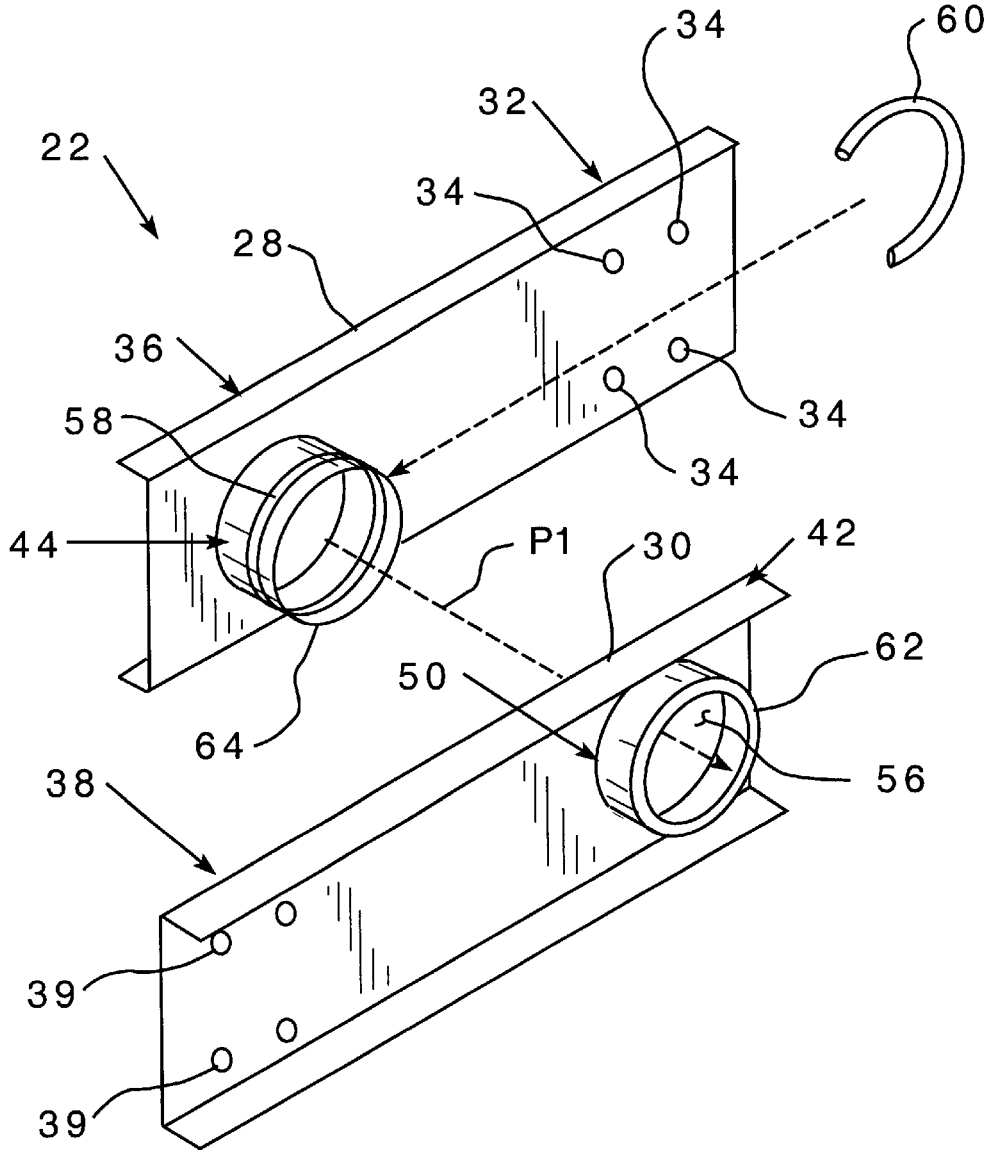
FIG. 2 is an isometric exploded assembly view of a hinge assembly in accordance with one embodiment of the invention.

As illustrated, for example, in FIG. 2, both the first boss 44 and the second boss 50 have a generally circular cross-section with the first boss 44 having a smaller diameter than the second boss 50. This configuration provides for the coaxial and pivotal receipt of the first boss 44 within the second boss 50 in order that the first hinge plate 28 and the second hinge plate 30 may pivot relative to each other about a pivot axis P1. Although the first boss 44 and the second boss 50 are shown as having generally circular cross-sections, it will be appreciated that other cross-sectional shapes and configurations may be provided in accordance with the invention that could facilitate a desirable amount of pivotal travel between the first hinge plate and the second hinge plate. It is preferred that a cross-section of the first boss 44 be generally complementary to a cross-section of the second boss 50 to facilitate the pivotal receipt of the first boss 44 in the second boss 50. In addition, by forming the first boss 44 and the second boss 50 with complementary cross sections, the cooperation between the first boss 44 and the second boss provides additional structural support to the hinge assembly 22 and, thus, to the truss assembly 10.

Figure 2A:
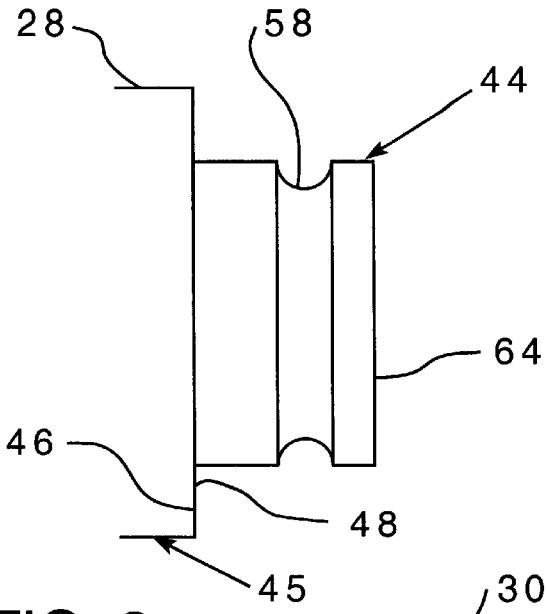
FIG. 2*a* is an end-elevational view of the first hinge plate shown in FIG. 2.
Figure 2B:
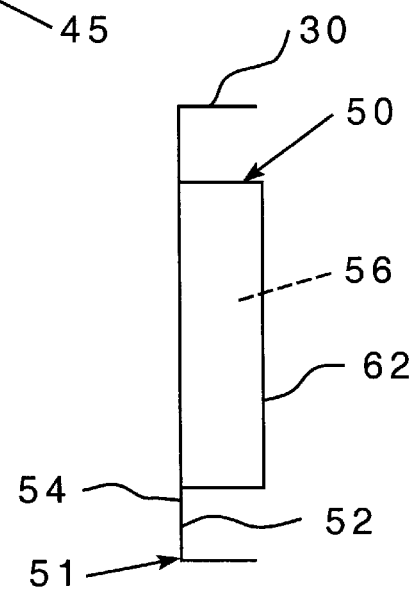
FIG. 2*b* is an end-elevational view of the second hinge plate shown in FIG. 2.
Figure 2C:
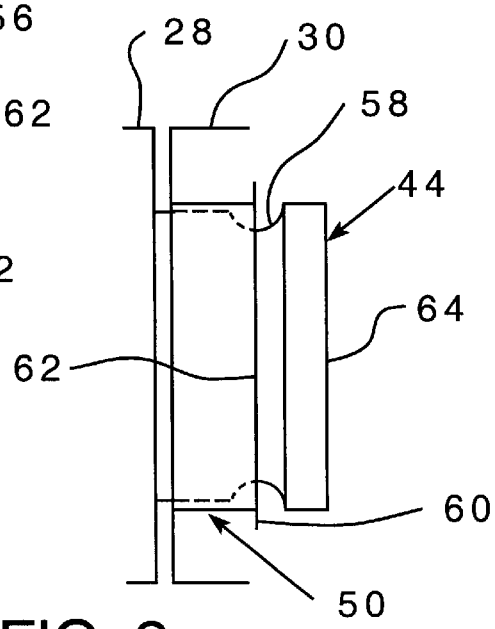
FIG. 2*c* is an end elevational view illustrating the first hinge plate of FIG. 2*a* and the second hinge plate of FIG. 2*b* as assembled.

To maintain the pivotal receipt of the first boss 44 in the second boss 50, the hinge assembly 22 may include a retainer attached to a terminal end 62 of the second boss 50. In the embodiment depicted in FIGS. 2, 2*a*, 2*b* and 2*c*, the first boss 44 defines a groove 58 on an outer periphery thereof for cooperating with a clip 60 for pivotally maintaining the first boss 44 in the second boss 50. Specifically, the first boss 44 is coaxially received in the second boss 50 such that a portion of the groove 58 extends beyond a terminal end 62 of the second boss 50. See FIG. 2*c*. The clip 60 is snapped into the groove 58 and cooperates with the terminal end 62 of the second boss 50 to pivotally maintain the first boss 44 within the second boss 50 and thereby pivotally secure the first hinge plate 28 to the second hinge plate 30. As illustrated in FIGS. 1, 2*a* and 2*c*, the groove 58 is preferably annular and is positioned adjacent a terminal end 64 of the first boss 44. Also, the groove 58 extends at least partially, and preferably entirely, about the outer periphery of the first boss 44 for receipt of the clip 60. The clip 60 may be manufactured from, for example, a steel or specialty steel material to provide a flexible, yet durable clamping arrangement to maintain the first boss 44 within the second boss 50.

Figure 6:
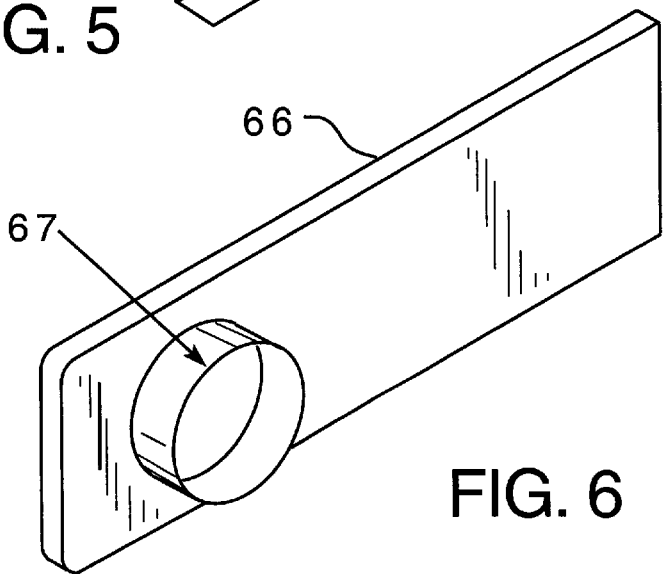
FIG. 6 is an isometric view illustrating an alternate construction for a component of a hinge assembly of the invention.

As shown in FIGS. 2 and 2*a*–2*c*, the first hinge plate 28 and the second hinge plate 30 may have a generally C-shape cross-section. When the first hinge plate 28 and the second hinge plate 30 are of generally C-shape cross-section, the outer web surface 48 of the first hinge plate 28 is positioned adjacent the outer web surface 54 of the second hinge plate 30 when the first boss 44 is received in the second boss 50 such that the C-shaped hinge plates are "back-to-back" to each other. Such back-to-back arrangement of the outer web surfaces 48 and 54 allows for an unobstructed, pivotal relationship between the first hinge plate 28 and the second hinge plate 30. It will be appreciated, however, that the first hinge plate 28 and the second hinge plate 30 may have other cross-sectional shapes or configurations. For example, as shown in FIG. 6, hinge plate 66 may have a generally rectangular cross-section. The hinge plate 66 may be formed with a boss 67, as desired, to function as either the first hinge plate or the second hinge plate in accordance with the invention and be advantageously attached to a variety of different building structures wherein the hinge assembly of the present invention is desirable.

The first hinge plate 28 and the second hinge plate 30 may be fabricated from a metal material such as, for example, cold rolled steel, hot rolled steel, stainless steel or aluminum. However, other materials such as wood, plastic, etc., could be successfully used to fabricate the first hinge plate 28 and the second hinge plate 30 in accordance with the invention. The reader will appreciate that, as with many building components, the structure design, loads, environment, etc., dictates the type and sizes of materials employed.

Figure 3:
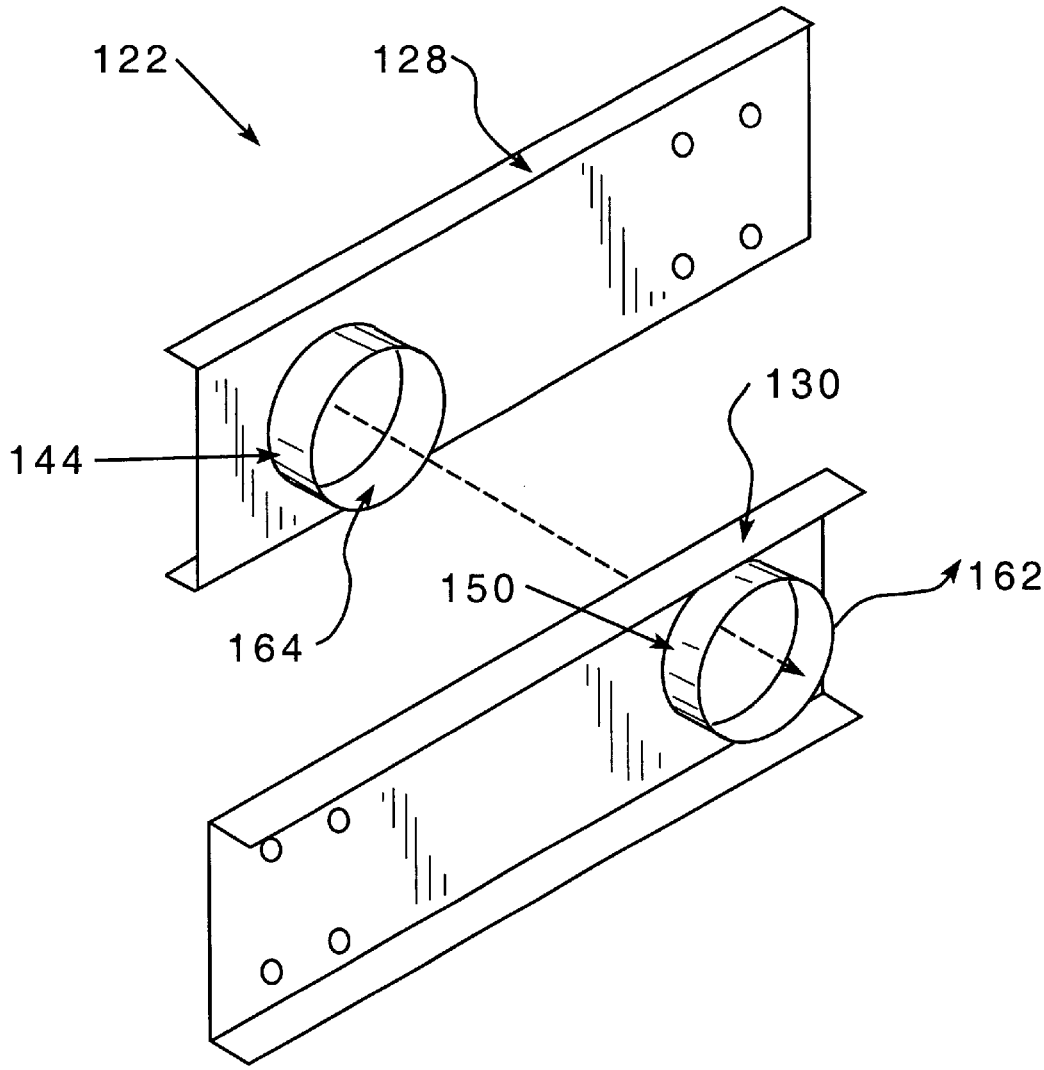
FIG. 3 is an isometric view of another embodiment of the hinge assembly in accordance with the invention.
Figure 3A:
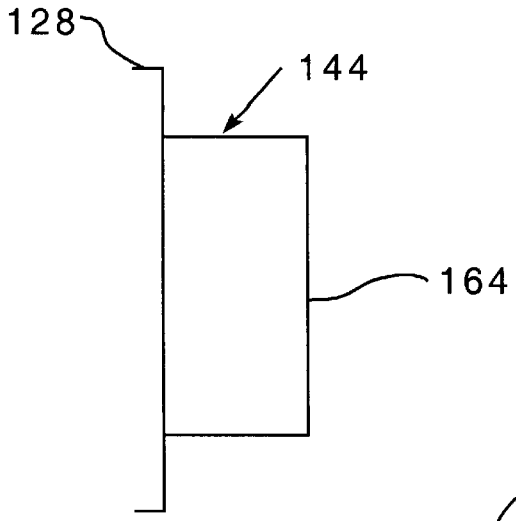
FIG. 3*a* is an end-elevational view of the first hinge plate shown in FIG. 3.
Figure 3B:
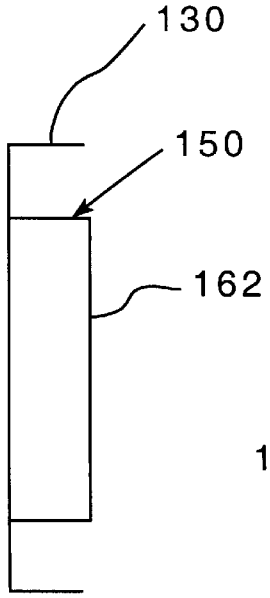
FIG. 3*b* is an end-elevational view of the second hinge plate shown in FIG. 3.
Figure 3C:
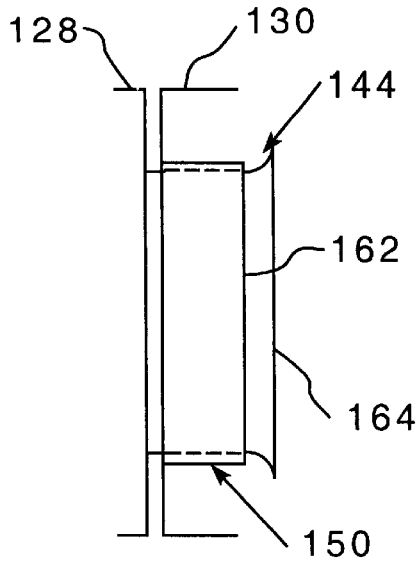
FIG. 3*c* an end elevational view illustrating the first hinge plate of FIG. 3*a* and the second hinge plate of FIG. 3*b* as assembled.
Figure 4:
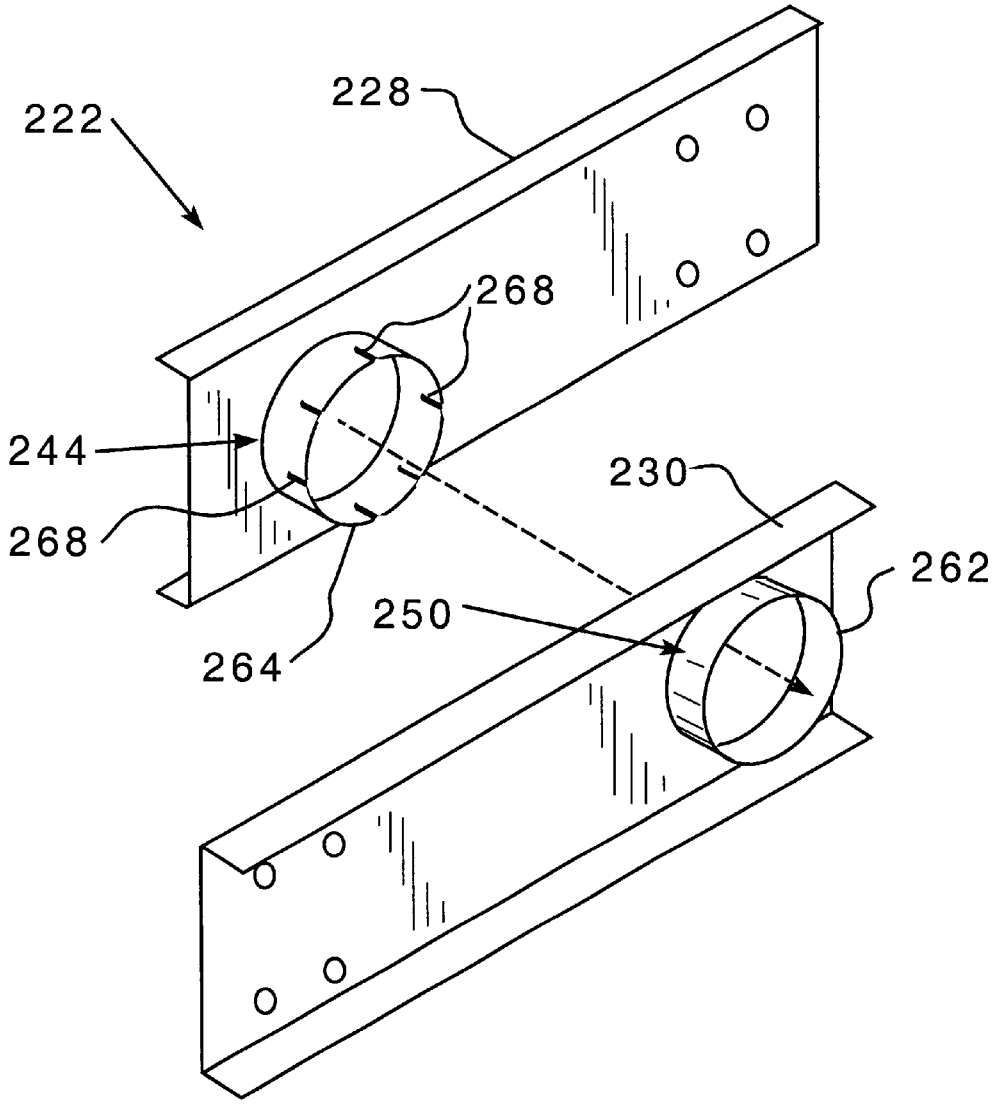
FIG. 4 is an exploded isometric assembly view of yet another embodiment of the hinge assembly in accordance with the invention.
Figure 4A:
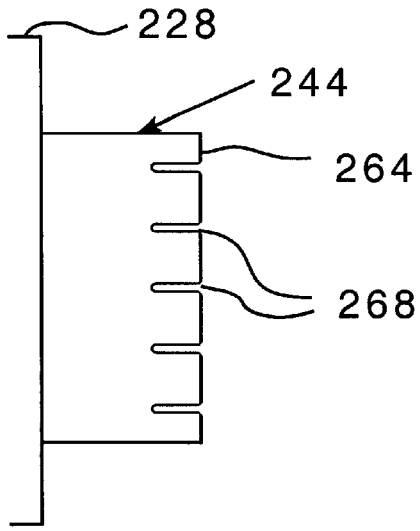
FIG. 4*a* is an end-elevational view of the first hinge plate shown in FIG. 4.
Figure 4B:
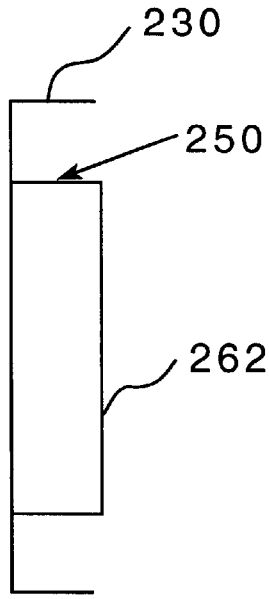
FIG. 4*b* is an end-elevational view of the second hinge plate shown in FIG. 4.
Figure 4C:
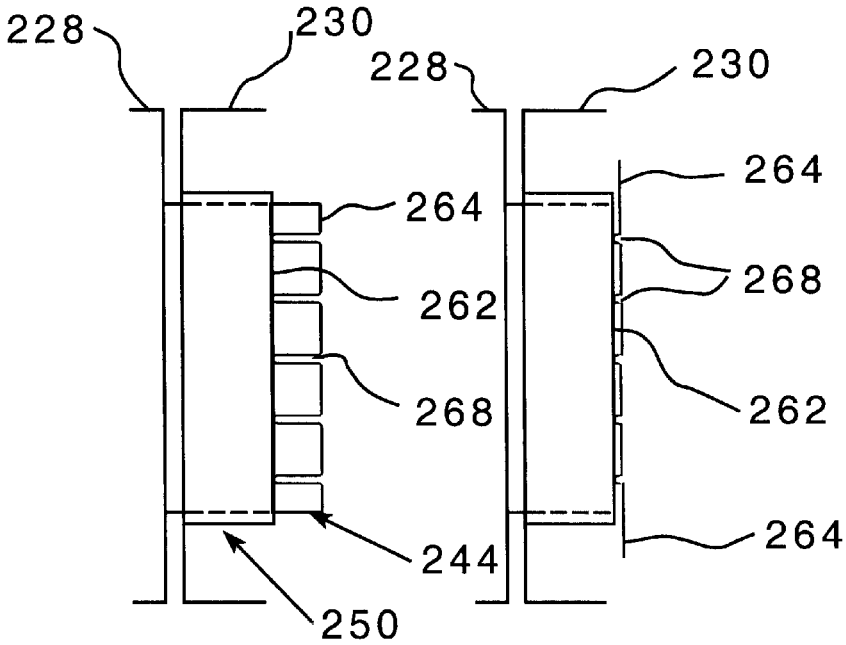
FIG. 4*c* is an end elevational view illustrating the first hinge plate of FIG. 4*a* and the second hinge plate of FIG. 4*b* as assembled.

In addition to the groove 58 and cooperating clip 60 for maintaining pivotal receipt of the first boss 44 in the second boss 50, additional means for maintaining the pivotal receipt of the first boss in the second boss in accordance with the invention are also disclosed. Specifically, referring to FIGS. 3 and 3*a*–3*c*, there is shown a hinge assembly 122 that includes a first hinge plate 128 and a second hinge plate 130. The first hinge plate 128 includes a first boss 144 that is pivotally received in a second boss 150 formed on the second hinge plate 130. Rather than utilizing the described groove 58 and cooperating clip 60 arrangement, the first boss 144 is received in the second boss 150 such that a terminal end 164 of the first boss 144 extends beyond a terminal end 162 of the second boss 150. The terminal end 164 of the first boss 144 is then bent over the terminal end 162 of the second boss (best shown in FIG. 3*c*) to maintain the pivotal receipt of the first boss 144 in the second boss 150

Referring to FIGS. 4 and 4*a*–4*c*, there is shown additional means for maintaining the pivotal receipt of the first boss in the second boss. Specifically, hinge assembly 222 includes first hinge plate 228 having a first boss 244 formed thereon and second hinge plate 230 having a second boss 250 formed thereon. The first boss 244 is similar to the first boss 144, described hereinabove, but the first boss 244 defines a plurality of slits 268 adjacent a terminal end 264 thereof. The slits 268 extend beyond the terminal end 262 of the second boss 250 such that the terminal end 264 of the first boss 244 may be bent over the terminal end 262 to maintain the pivotal receipt of the first boss 244 in the second boss 250 (best shown in FIG. 4*c*. In addition, the slits 268 would permit the material to be less ductile, and to prevent cracking during forming.

Figure 5:
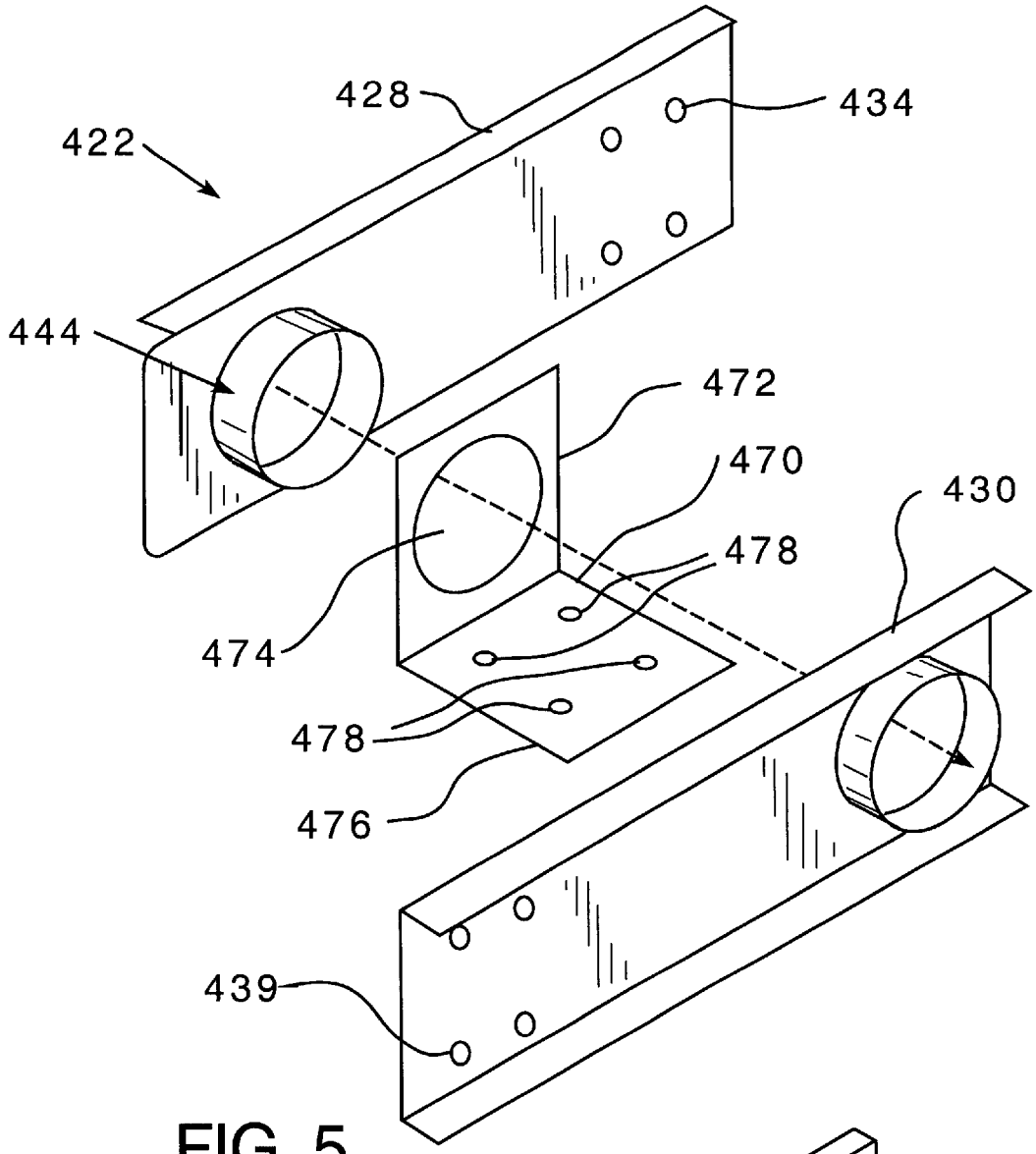
FIG. 5 is an exploded isometric assembly view of a hinge assembly of the invention incorporating a clip angle for securing the hinge assembly and, more particularly, the truss assembly to a structure.
Figure 5A:
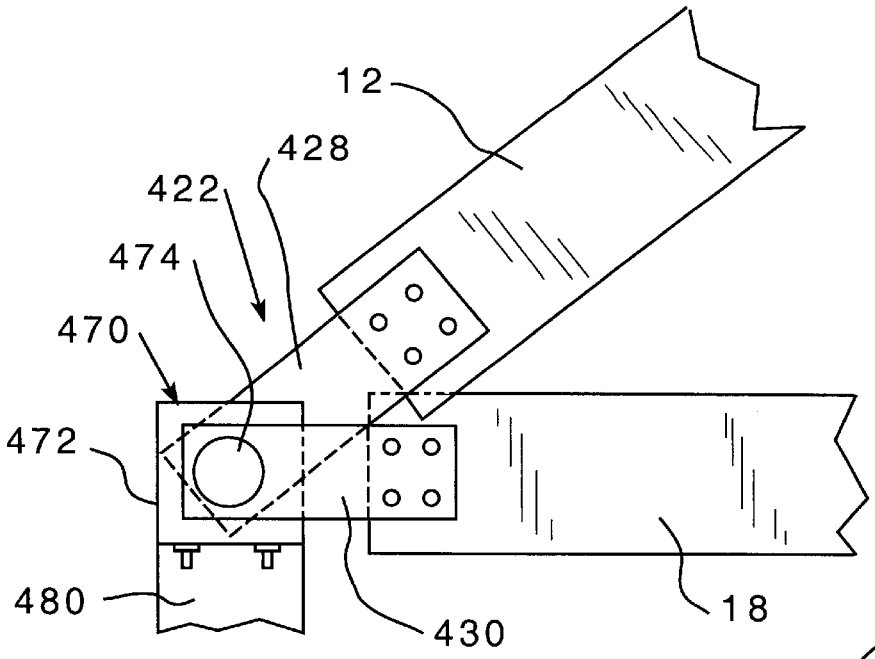
FIG. 5*a* is a partial view illustrating the hinge assembly and clip angle shown in FIG. 5, as secured to a structure.

Referring to FIGS. 5 and 5*a*, there is shown an additional feature of the invention. Specifically, hinge assembly 422 includes a first hinge plate 428, defining a plurality of apertures 434 on one end thereof, and a second hinge plate 430, defining a plurality of apertures 439 on one end thereof, having a clip angle 470 disposed therebetween. The clip angle 470 facilitates attachment of the hinge assembly 422 to the top of a wall or other structure. Specifically, the clip angle 470 includes a first member 472 which defines an opening 474 for receiving the first boss 444 of the first hinge plate 428. The clip angle 470 also includes a second member 476 which defines a plurality of apertures 478 for receiving a plurality of corresponding fasteners 479 (see FIG. 5*a*) for securing the hinge assembly 422, and more particularly a truss assembly incorporating the hinge assembly 422, to the top of a wall 480 (see FIG. 5*a*) or other structure. The clip angle 470 may be constructed of materials similar to the materials that may be used to construct the hinge assemblies, as described herein. Also, the first member 472 and the second member 476 may be formed at various angles to each other, as needed.

Figure 7:
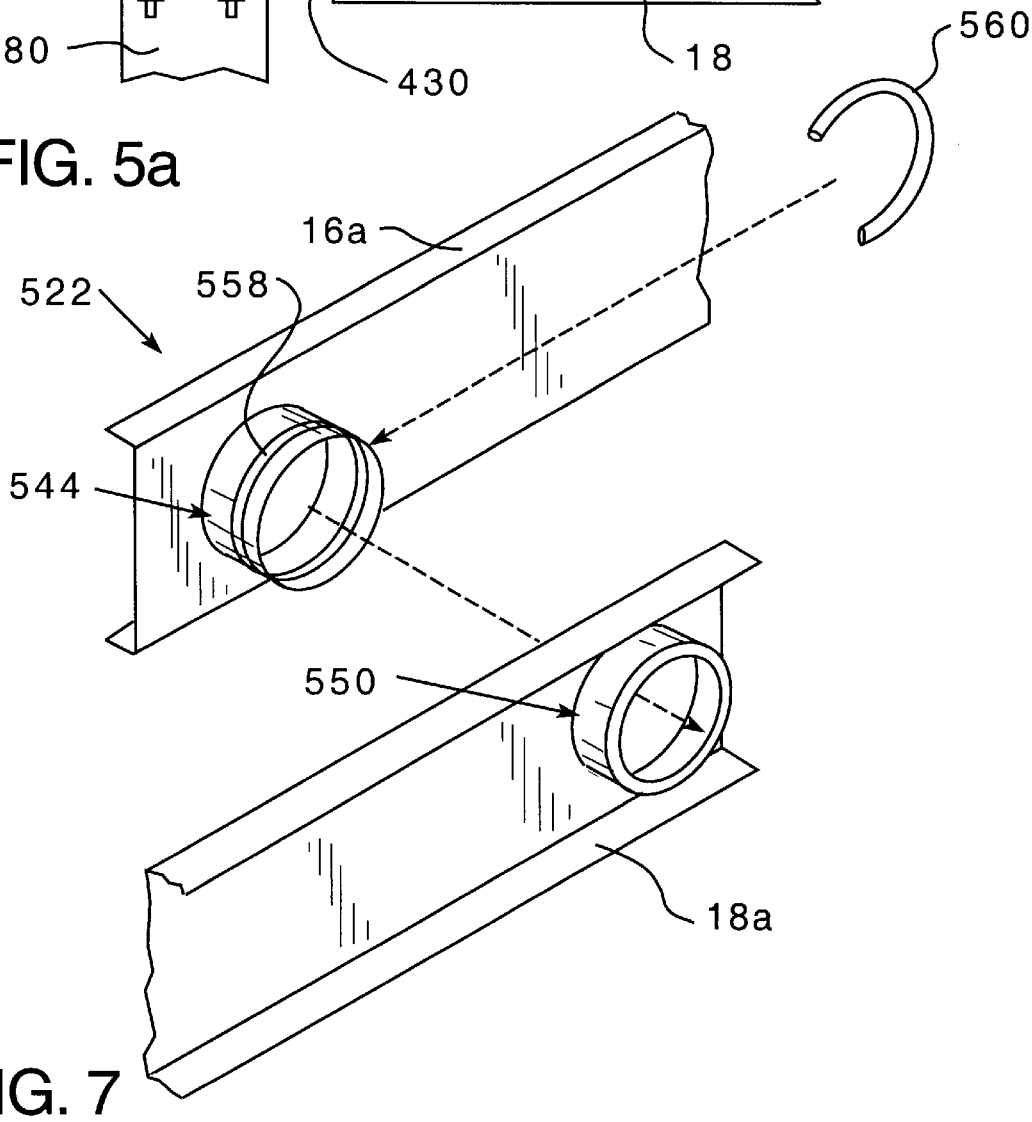
FIG. 7 is an exploded isometric view illustrating another embodiment of the invention.

Referring to FIG. 7, there is shown an additional feature of the invention. Specifically, assembly 522 includes a hinged arrangement that is formed directly on the first truss member 16*a* and second truss member 18*a*. The first boss 544 is formed to protrude generally outwardly from the first truss member 16*a* and the second boss 550 is formed to protrude generally outwardly from the second truss member 18*a*. The first boss 544 defines a groove on an outer periphery thereof for cooperating with a clip 560 for pivotally maintaining the first boss 544 in the second boss 550. Otherwise, the first boss 544 and the second boss 550 are similar to the description of the first boss 44 and the second boss 50 shown in FIGS. 2–2*c*. The essential difference is that the need for the first and second hinge plates is eliminated by forming the first boss 544 directly on the first truss member 16a and directly forming the second boss 550 on the second truss member 18*a*. Of course, it will be appreciated that other means for maintaining the pivotal relationship between the first boss 544 and the second boss 550, such as shown and described in FIGS. 3–3*c* and FIGS. 4–4*c*, may be utilized in conjunction with the assembly 522.

The hinge assemblies, as described herein, may be fabricated or manufactured by, for example, feeding a coil of material, such as galvanized steel, through a series of progressive dies utilizing, for example, an uncoiler, a flattener/feeder, an electronic servo controlled roll feeder, an approximately sized straight-side press, and a packaging system, all of which are known components of manufacturing equipment. For example, in forming the hinge plates 128 and 130, each part may be formed by undergoing a first progression wherein punch holes and a blank pilot hole are formed for the extrusion followed by additional progressions to finish the extruded profile, to form the particular shape of the hinge plates and to cut the part from the coil from which originally fed.

As used herein, the phrase "formed on" in regards to, for example, the first boss or the second boss being formed on a particular component, generally refers to either the bosses being integrally formed with the hinge plates or the truss members, or the bosses being separate components that are attached to the hinge plates or truss members by, for example, tack welding, screws, rivets or other known means of fastening structural components.

Thus, as can be appreciated from the foregoing discussion, the present invention provides many solutions associated with fabricating and transporting building components, such as trusses and the like. In particular, the hinge assembly of the present invention is relatively easy to manufacture, assemble and install. It can be effectively used in connection with a variety of different materials ranging from metal, wood, plastic, etc. Use of the present hinge assembly in connection with a truss can enable various truss components to be collapsed to provide the truss with a more compact size that is more compatible with shipping restrictions that may be dictated by local transportation codes.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the invention as described in the appended claims.

What is claimed is:

1. A hinge assembly for a truss having a first truss member and a second truss member, the hinge assembly comprising:

a first hinge plate having an attachment portion secured to the first truss member and an extension portion that extends from the first truss member;

said first hinge plate having a first boss formed on said extension portion thereof;

a second hinge plate having an attachment portion secured to the second truss member and an extension portion that extends from the second truss member;

said second hinge plate having a second boss formed on said extension portion thereof, said second boss defining an opening for pivotal receipt of said first boss, said second boss having a terminal end; and a retainer attached to said terminal end of said second boss to maintain the pivotal receipt of said first boss in said second boss.

2. The hinge assembly of claim 1 wherein said retainer comprises a clip received in a groove provided in said first boss.

3. The hinge assembly of claim 1, wherein said first boss has a generally circular cross-section.

4. The hinge assembly of claim 2, wherein said groove in said first boss is annular.

5. The hinge assembly of claim 2, wherein said groove in said first boss extends at least partially about said outer periphery thereof.

6. The hinge assembly of claim 2, wherein said groove is defined by said first boss adjacent a terminal end of said first boss.

7. The hinge assembly of claim 1, wherein said second boss has a generally circular cross-section.

8. The hinge assembly of claim 1, wherein a cross-section of said first boss is generally complementary to a cross-section of said second boss.

9. The hinge assembly of claim 1, wherein said first hinge plate has a generally c-shape cross-section.

10. The hinge assembly of claim 1, wherein said second hinge plate has a generally c-shape cross-section.

11. The hinge assembly of claim 1, wherein said first hinge plate has a generally rectangular cross-section.

12. The hinge assembly of claim 1, wherein said second hinge plate has a generally rectangular cross-section.

13. The hinge assembly of claim 1, wherein said first hinge plate includes an inner web surface and an outer web surface, said first boss protruding outwardly from said outer web surface of said first hinge plate.

14. The hinge assembly of claim 13, wherein said second hinge plate includes an inner web surface and an outer web surface, said second boss protruding outwardly from said inner web surface of said second hinge plate.

15. The hinge assembly of claim 14, wherein said outer web surface of said first hinge plate is positioned adjacent said outer web surface of said second hinge plate.

16. A hinge assembly for a truss having a first truss member and a second truss member, the hinge assembly comprising:

a first hinge plate having an attachment portion secured to the first truss member and an extension portion that extends from the first truss member, said first hinge plate having a first boss formed on said extension portion thereof;

a second hinge plate having an attachment portion secured to the second truss member and an extension portion that extends from the second truss member, said second hinge plate having a second boss formed on said extension portion thereof, said second boss defining an opening for pivotal receipt of said first boss; and means for maintaining the pivotal receipt of said first boss in said second boss.

17. The hinge assembly of claim 16, wherein said first boss has a generally circular cross-section.

18. The hinge assembly of claim 16, wherein said second boss has a generally circular cross-section.

19. The hinge assembly of claim 16, wherein a cross-section of said first boss is generally complementary to a cross-section of said second boss.

20. The hinge assembly of claim 16, wherein said first hinge plate has a generally c-shape cross-section.

21. The hinge assembly of claim 16, wherein said second hinge plate has a generally c-shape cross-section.

22. The hinge assembly of claim 16, wherein said first hinge plate has a generally rectangular cross-section.

23. The hinge assembly of claim 16, wherein said second hinge plate has a generally rectangular cross-section.

24. The hinge assembly of claim 16, wherein said first hinge plate includes an inner web surface and an outer web surface, said first boss protruding outwardly from said outer web surface of said first hinge plate.

25. The hinge assembly of claim 24, wherein said second hinge plate includes an inner web surface and an outer web surface, said second boss protruding outwardly from said inner web surface of said second hinge plate.

26. The hinge assembly of claim 25, wherein said outer web surface of said first hinge plate is positioned adjacent said outer web surface of said second hinge plate.

27. The hinge assembly of claim 16, wherein said extension portion of said first hinge plate extends generally longitudinally from said first truss member along a longitudinal axis of said first truss member.

28. The hinge assembly of claim 16, wherein said extension portion of said second hinge plate extends generally longitudinally from said second truss member along a longitudinal axis of said second truss member.

29. A hinge assembly for a truss having a first truss member and a second truss member, the hinge assembly comprising:

a first hinge plate having an attachment portion secured to the first truss member and an extension portion that extends from the first truss member;

said first hinge plate having a first boss formed on said extension portion thereof, said first boss having a terminal end;

a second hinge plate having an attachment portion secured to the second truss member and an extension portion that extends from the second truss member; and said second hinge plate having a second boss formed on said extension portion thereof, said second boss defining an opening for pivotal receipt of said first boss, said second boss having a terminal end, said terminal end of said first boss bent over said terminal end of said second boss to maintain the pivotal receipt of said first boss in said second boss.

30. A hinge assembly for a truss having a first truss member and a second truss member, the hinge assembly comprising:

a first hinge plate having an attachment portion secured to the first truss member and an extension portion that extends from the first truss member;

said first hinge plate having a first boss formed on said extension portion thereof, said first boss defining a plurality of slits adjacent a terminal end thereof;

a second hinge plate having an attachment portion secured to the second truss member and an extension portion that extends from the second truss member; and said second hinge plate having a second boss formed on said extension portion thereof, said second boss defining an opening for pivotal receipt of said first boss, said second boss having a terminal end, said terminal end of said first boss bent over said terminal end of said second boss to maintain the pivotal receipt of said first boss in said second boss, said plurality of slits facilitating the bending of said terminal end of said first boss.

31. A truss assembly, comprising:

a truss having a first truss member and a second truss member; and a hinge assembly for pivotally connecting said first truss member and said second truss member, said hinge assembly comprising:

a first hinge plate having an attachment portion secured to said first truss member and an extension portion that extends from said first truss member;

said first hinge plate having a first boss formed on said extension portion thereof;

a second hinge plate having an attachment portion secured to said second truss member and an extension portion that extends from said second truss member;

said second hinge plate having a second boss formed on said extension portion thereof, said second boss defining an opening for pivotal receipt of said first boss, said second boss having a terminal end; and a retainer attached to said terminal end of said second boss to maintain the pivotal receipt of said first boss in said second boss.

32. The truss assembly of claim 31, further comprising a clip angle secured between said first hinge plate and said second hinge plate, said clip angle including a first member defining an opening for receiving said first boss.

33. The truss assembly of claim 32, wherein said clip angle includes a second member for securing the truss assembly to a structure.

34. A truss assembly, comprising:

a truss having a first truss member and a second truss member; and a hinge assembly for pivotally connecting said first truss member and said second truss member, said hinge assembly comprising:

a first hinge plate having an attachment portion secured to said first truss member and an extension portion that extends from said first truss member, said first hinge plate having a first boss formed on said extension portion thereof;

a second hinge plate having an attachment portion secured to said second truss member and an extension portion that extends from said second truss member said second hinge plate having a second boss formed on said extension portion thereof, said second boss defining an opening for pivotal receipt of said first boss; and means for maintaining the pivotal receipt of said first boss in said second boss.

35. A truss assembly for mounting to a structure, comprising:

a truss having a first truss member and a second truss member; and a hinge assembly for pivotally connecting said first truss member and said second truss member, said hinge assembly comprising:

a first hinge plate having an attachment portion secured to said first truss member and an extension portion that extends from said first truss member, said first hinge plate having a first boss formed on said extension portion thereof;

a second hinge plate having an attachment portion secured to said second truss member and an extension portion that extends from said second truss member, said second hinge plate having a second boss formed on said extension portion thereof, said second boss defining an opening for pivotal receipt of said first boss, said second boss having a terminal end;

a retainer attached to said terminal end of said second boss to maintain the pivotal receipt of said first boss in said second boss; and a clip angle secured between said first hinge plate and said second hinge plate, said clip angle including a first member defining an opening for receiving said first boss, said clip angle further including a second member for securing the truss assembly to the structure.

36. A truss assembly, comprising:

a truss having a pair of first truss members and a pair of second truss members; and at least two hinge assemblies for pivotally connecting respective said first truss members to said second truss members, each said hinge assembly comprising:

a first hinge plate having an attachment portion secured to one of said first truss members and an extension portion that extends from one of said first truss members, said first hinge plate having a first boss formed on said extension portion thereof;

a second hinge plate having an attachment portion secured to one of said second truss members and an extension portion that extends from one of said second truss members, said second hinge plate having a second boss formed on said extension portion thereof, said second boss defining an opening for pivotal receipt of said first boss, said second boss having a terminal end; and a retainer attached to said terminal end of said second boss to maintain the pivotal receipt of said first boss in said second boss.

37. A truss assembly, comprising:

a truss having a first truss member and a second truss member;

said first truss member having a first boss formed thereon;

said second truss member having a second boss formed thereon, said second boss defining an opening for pivotal receipt of said first boss thereby pivotally connecting said first truss member and said second truss member, said second boss having a terminal end; and a retainer attached to said terminal end of said second boss to maintain the pivotal receipt of said first boss in said second boss.

38. A truss assembly, comprising:

a truss having a first truss member and a second truss member;

said first truss member having a first boss formed thereon;

said second truss member having a second boss formed thereon, said second boss defining an opening for pivotal receipt of said first boss thereby pivotally connecting said first truss member and said second truss member; and means for maintaining the pivotal receipt of said first boss in said second boss.

39. A truss assembly, comprising:

a truss having a first truss member and a second truss member;

said first truss member having a first boss formed thereon, said first boss having a terminal end; and said second truss member having a second boss formed thereon, said second boss defining an opening for pivotal receipt of said first boss thereby pivotally connecting said first truss member and said second truss member, said second boss having a terminal end, said terminal end of said first boss bent over said terminal end of said second boss to maintain the pivotal receipt of said first boss in said second boss.

40. A truss assembly, comprising:

a truss having a first truss member and a second truss member;

said first truss member having a first boss formed thereon, said first boss defining a plurality of slits adjacent a terminal end thereof; and said second truss member having a second boss formed thereon, said second boss defining an opening for pivotal receipt of said first boss thereby pivotally connecting said first truss member and said second truss member, said second boss having a terminal end, said terminal end of said first boss bent over said terminal end of said second boss to maintain the pivotal receipt of said first boss in said second boss, said plurality of slits facilitating the bending of said terminal end of said first boss.

* * * * *